United States Patent [19]

Matta

[11] Patent Number: 4,867,432

[45] Date of Patent: Sep. 19, 1989

[54] SIGNATURE HANDLING APPARATUS AND METHOD

[75] Inventor: Nagi D. Matta, Los Angeles, Calif.

[73] Assignee: GTE Directories Press, Inc., Los Angeles, Calif.

[21] Appl. No.: 608,221

[22] Filed: May 8, 1984

[51] Int. Cl.[4] ..... B65H 3/08

[52] U.S. Cl. ..... 271/9; 270/54; 271/11; 271/31.1; 271/107; 271/150

[58] Field of Search ..... 271/5, 9, 11, 149, 150, 271/151, 107, 31.1, 129; 270/54, 58

[56] References Cited

U.S. PATENT DOCUMENTS

| | | | |
|---|---|---|---|
| 691,933 | 1/1902 | Dexter | 271/31.1 X |
| 3,079,147 | 2/1963 | Childs . | |
| 3,127,166 | 3/1964 | Fawdry | 271/11 |
| 3,149,835 | 9/1964 | Branscome | 271/250 |
| 3,259,384 | 7/1966 | Hittenberger | 271/31.1 X |
| 3,565,422 | 2/1971 | McCain | 271/11 |
| 3,871,640 | 3/1975 | Ritzerfeld | 271/149 X |
| 4,177,982 | 12/1979 | Bewersdorf | 271/150 X |

*Primary Examiner*—Richard A. Schacher
*Attorney, Agent, or Firm*—Christie, Parker & Hale

[57] ABSTRACT

A stack of signatures is transformed into a moving stream of individually arranged signatures by feeding a stack of signatures on edge to a transfer station, individually transporting the signatures as a moving stream away from an entrance location laterally offset from the stack, and carrying each signature of the stack in turn laterally to the entrance location as such signature arrives at the transfer station. As each signature is carried laterally to the entrance location, such signature is separated from the stack so as to prevent mutilation due to friction with the adjacent signature on the stack. The signatures are carried to the entrance location by suction cups that form part of a transfer arm. The transfer arm is momentarily transported away from the stack as it carries the signature to the entrance location so as to effect separating of the signature from the stack. The stack of signatures is intermittently fed to the transfer stating such that feeding is arrested while each signature is carried to the entrance location. Air is injected between the signature being carried to the entrance and the stack to facilitate separation of the former from the latter. The transfer arm travels in a tilted oval path that permits the transfer arm to engage the signatures at the end of the stack while moving in part toward the entrance location, thereby reducing the relative velocity between them on contact.

21 Claims, 17 Drawing Sheets

140a
10
10
141a
114a
121a
10
121a
10
120a
161
112a
27a
16
38a
24a
25
13
10
37
10
36
18
21
15
20
17
19

SIGNATURE HANDLING APPARATUS AND METHOD

BACKGROUND OF THE INVENTION

This invention relates to signature handling and, more particularly, to apparatus and a method for transforming a stack of signatures into a moving stream of individually arranged signatures for collating purposes.

In the manufacture of books, as the individual signatures comprising the book leave the printing press, they are collated in a signature gathering machine preparatory to binding. A gathering machine has hoppers in which the signatures are stacked on top of each other and gripping fingers that pull the signatures one at a time in turn from the bottom of the stack so each signature can be collated with the other signatures comprising the book One station of a typical gathering machine is disclosed in Hageman et al U.S. Pat. No. 3,650,525, which issued on Mar. 21, 1972. Hageman et al disclose a rotary drum mechanism with suction detacher means and carrying grippers. With each revolution of the rotary drum mechanism, the suction detacher means and carrying grippers remove one signature from the bottom of the stack.

If many signatures are stacked in the hopper of a gathering machine, the weight bearing on the bottom signature is too great to permit its removal from the stack. Therefore, the height of the stack of signatures in the hopper must be closely controlled. When signatures are manually loaded into the hoppers, the loading operation requires constant and close attention by the attendants to insure that the hopper does not become empty or too full. Generally, the loading operation requires at least one attendant for every three hoppers, which represents a substantial labor expense in a book manufacturing operation.

Knopp U.S. Pat. No. 3,945,633, which issued Mar. 23, 1976, discloses a hopper loading machine. The signatures are manually loaded onto a horizontal conveyor on edge. These signatures are fed by the horizontal conveyor to an inclined conveyor, which carries the signatures in a shingled stream to the top of a hopper for a gathering machine. The signatures are automatically fed to the hopper to control the height of the signatures therein. Many more signatures can be loaded on edge onto a horizontal conveyor than can be loaded in the hopper on top of each other, and therefore, less operator attention is required. The described hopper loader does not work effectively on ¼ fold signatures having a paper weight of 22.5 pounds or less, such as telephone book paper. Moreover, the maximum feed rate is about 120 signatures per minute and the signatures are not delivered in synchronism with the pin chain of the gathering machine.

Mueller Martini AG, a Swiss company, offers for sale a gathering machine in which a stack of signatures on edge is fed to a rotary drum mechanism of the type disclosed in the above-mentioned Hageman et al patent. As a result, the signatures in the stack are fed by vacuum suckers and grippers of the rotary drum mechanism to the gathering track one at a time in synchronism with the pin chain. Under some conditions, this gathering machine experiences many missed signatures, i.e., the rotary drum mechanism fails to pick up a signature with each rotation. As a result, many rejects are produced during book manufacture.

SUMMARY OF THE INVENTION

According to the invention, a stack of signatures is transformed into a moving stream of individually arranged signatures by feeding a stack of signatures on edge to a transfer station, individually transporting the signatures as a moving stream on a conveyor away from an entrance location laterally offset from the stack, and carrying each signature of the stack in turn laterally to the entrance location as such signature arrives at the transfer station. As each signature is carried laterally to the entrance location, it is also pulled away from the stack so as to prevent double signature due to friction with the adjacent signature on the stack. Preferably, the signatures in the stack are vertically arranged and are carried in a vertical direction to the entrance location. In this manner, ¼ fold or ½ fold signatures can be fed to a hopper of a gathering machine or directly to a gathering machine at a rate of up to 200 signatures per minute.

Preferably, the signatures are carried to the entrance location by vacuum cups that form part of a transfer arm. The transfer arm is momentarily transported away from the stack as it carries the signature to the entrance location so as to effect separation of the signature from the stack. Thus, the transfer arm moves in two directions relative to the stack, namely away from the stack and laterally with respect to the stack.

As a feature of the invention, as the transfer arm carries each signature to the entrance location of the conveyor, it travels at approximately the same linear speed as the conveyor. As a result, the signatures are fed smoothly into the conveyor without jamming or mutilation.

As another feature of the invention, the transfer arm is so positioned relative to the stack at the transfer station and the entrance location of the conveyor as to engage two shingled signatures at a time — one signature being transported by the conveyor and one signature being separated from the stack. Thus, the conveyor assists the transfer arm in carrying each signature laterally from the stack to the entrance location by virtue of coupling between the shingled signatures. As a result, if the transfer arm uses vacuum cups, the strength of the vacuum can be reduced without increasing the number of missed signatures, which permits operation at a higher speed.

As another feature of the invention, erroneous pick up of double signatures at the transfer station is detected and corrected. Responsive to the detection of a double signature, pick up of the next signature by the transfer arm is aborted to create a missing signature position and one of the double signatures is shifted back to the missing signature position while in the conveyor. As a result, correction of a double signature condition is accomplished without shutdown of operation.

As another feature of the invention, the stack of signatures is intermittently fed to the transfer station such that feeding is arrested while each signature is carried to the entrance location. The increment of signature advance toward the transfer station is automatically adjusted to accommodate for different signature thicknesses.

As another feature of the invention, a gas, e.g., air, is injected between the signature being carried to the entrance and the stack to facilitate separation of the former from the latter.

As another feature of the invention, the transfer arm travels in a tilted oval path that permits the transfer arm to engage the signatures at the end of the stack while moving in part toward the entrance location, thereby reducing the relative velocity between them on contact. This further reduces the likelihood of a missed signature.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
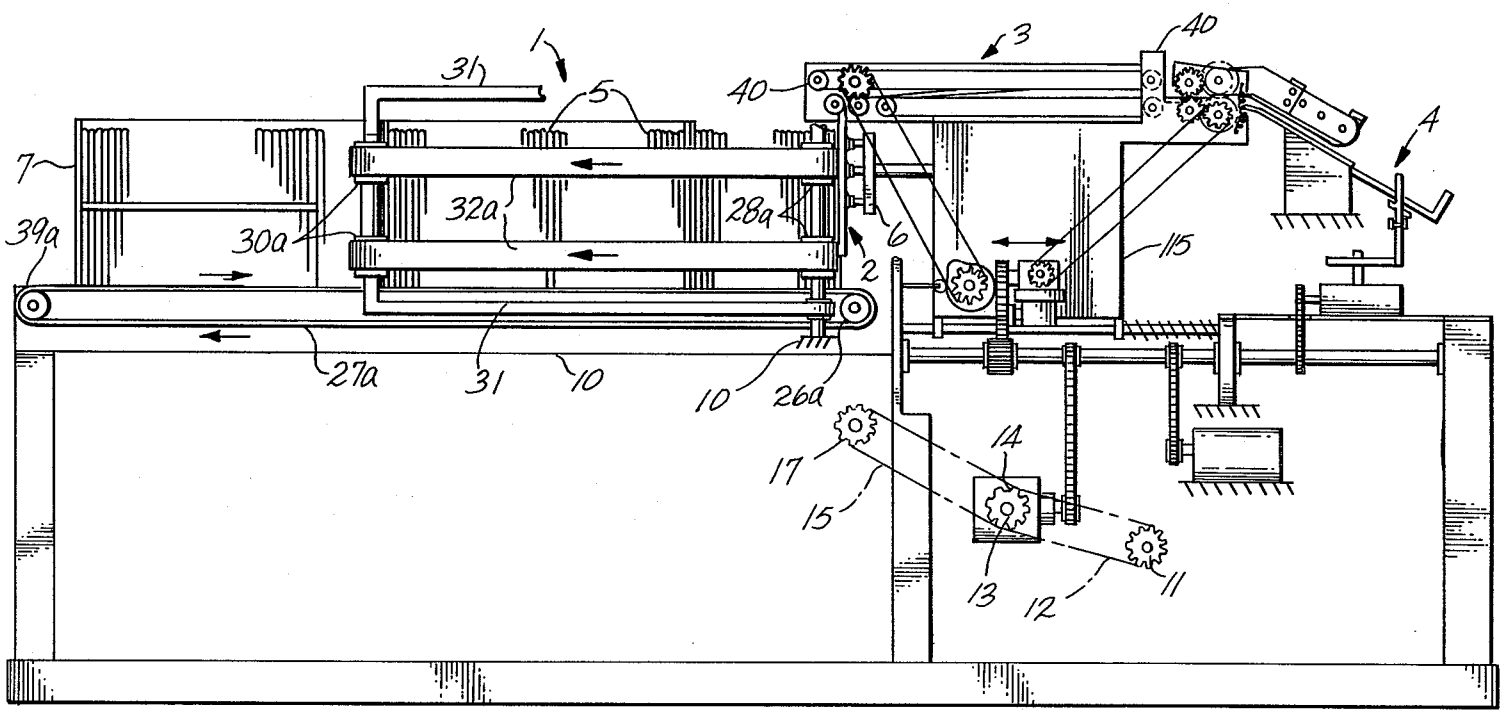
FIG. 1 is a side elevation view of apparatus incorporating principles of the invention.
Figure 2:
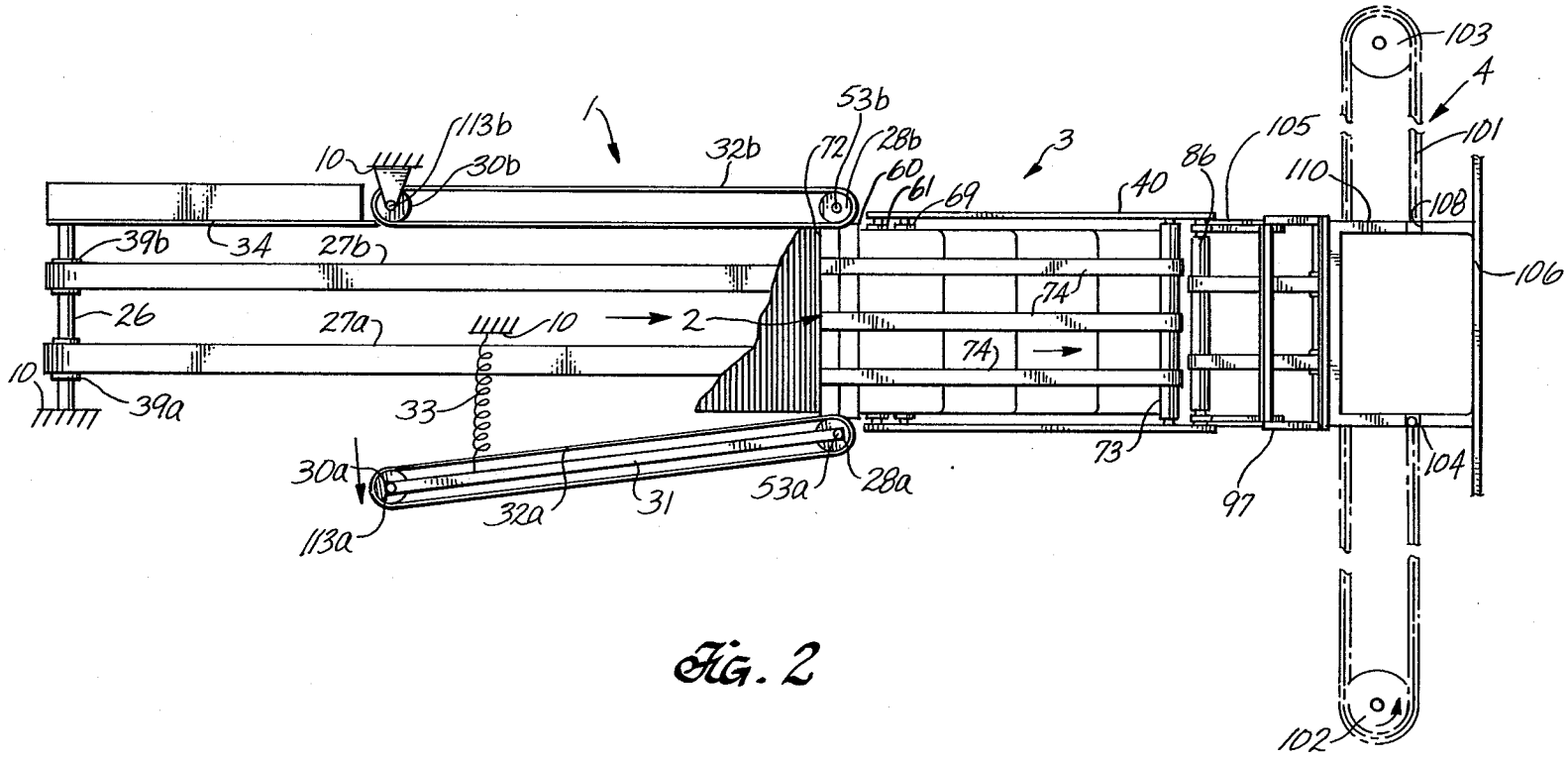
FIG. 2 is a top plan view of the apparatus of FIG. 1 without signatures.

In FIGS. 1 and 2, signature-handling apparatus comprises a signature feeder 1, a transfer station 2, a signature conveyor 3, and a signature gathering track 4. Briefly, a plurality of face abutting signatures are arranged on edge to form a stack 5 that is carried in incremental steps to transfer station 2 by intermittent operation of feeder 1. Preferably, the signatures of stack 5 lie in a vertical plane so each signature does not bear any of the weight of the other signatures. As each signature in turn arrives at transfer station 2, it is individually carried by a transfer arm 6 from stack 5 laterally, preferably in a direction perpendicular to the movement of stack 5 to conveyor 3. As such signature is carried from transfer station 2 to conveyor 3, substantially its entire face is separated from stack 5 to prevent double signature pickup signature due to friction with the adjacent signature in stack 5. Transfer arm 6 is so positioned relative to the stack and the entrance of conveyor 3 as to engage two shingled signatures during each cycle of operation — namely, the signature being separated from stack 5 and the preceding signature entering conveyor 3. As a result of the coupling between these two shingled signatures, conveyor 3 assists transfer arm 6 in overcoming the inertia of the signatures as they are carried from stack 5 to conveyor 3. Separation of the signatures being carried by transfer arm 6 from the remainder of stack 5 is effectuated by transporting transfer arm 6 away from stack 5 immediately after it engages each signature in stack 5. To this end, transfer station 2, conveyor 3, and transfer arm 6 are mounted on a translatable carriage 115 described in more detail below. Air is blown between the signature being carried by transfer arm 6 and stack 5 to facilitate separation. Feeder 1 is intermittently operated so that it is stopped while transfer arm 6 is carrying the signature to conveyor 3 so as to relieve the force exerted on the signature being carried from the remainder of stack 5. This plus the lack of weight bearing on the signature being carried due to the vertical arrangement reduces or substantially eliminates any detrimental friction to the extent the signature being carried contacts stack 5. As a result of the operation of transfer arm 6, the signatures are delivered to conveyor 3 in shingled form. Conveyor 3 separates the shingled signatures and transports them to one station of gathering track 4, which collates the signatures handled by the described apparatus with signatures from a plurality of other stations each provided with the described signature handling apparatus. The construction of gathering track 4, and its mode of operation are, in and of themselves, well known.

Although the signatures could either be ¼ fold or ½ fold, the apparatus can easily handle the more difficult ¼ fold signatures. The signatures of stack 5 could be any thickness. Typically, these signatures are 11½ inches by 9½ inches with an upwardly facing fold on one of the 11½-inch sides and are 1/16 of an inch thick.

Reference numerals of parts that are duplicated on each side of the apparatus include the letters "a" and "b" on the side visible from FIG. 1 and the opposite side, respectively. Arrows designate the direction of rotation and the direction of spring bias of the parts in the drawings.

The parts of the apparatus are mounted on a support frame 10. The motor that drives the pin chain of gathering track 4 is also the prime mover for all the parts of the apparatus.

Figure 8:
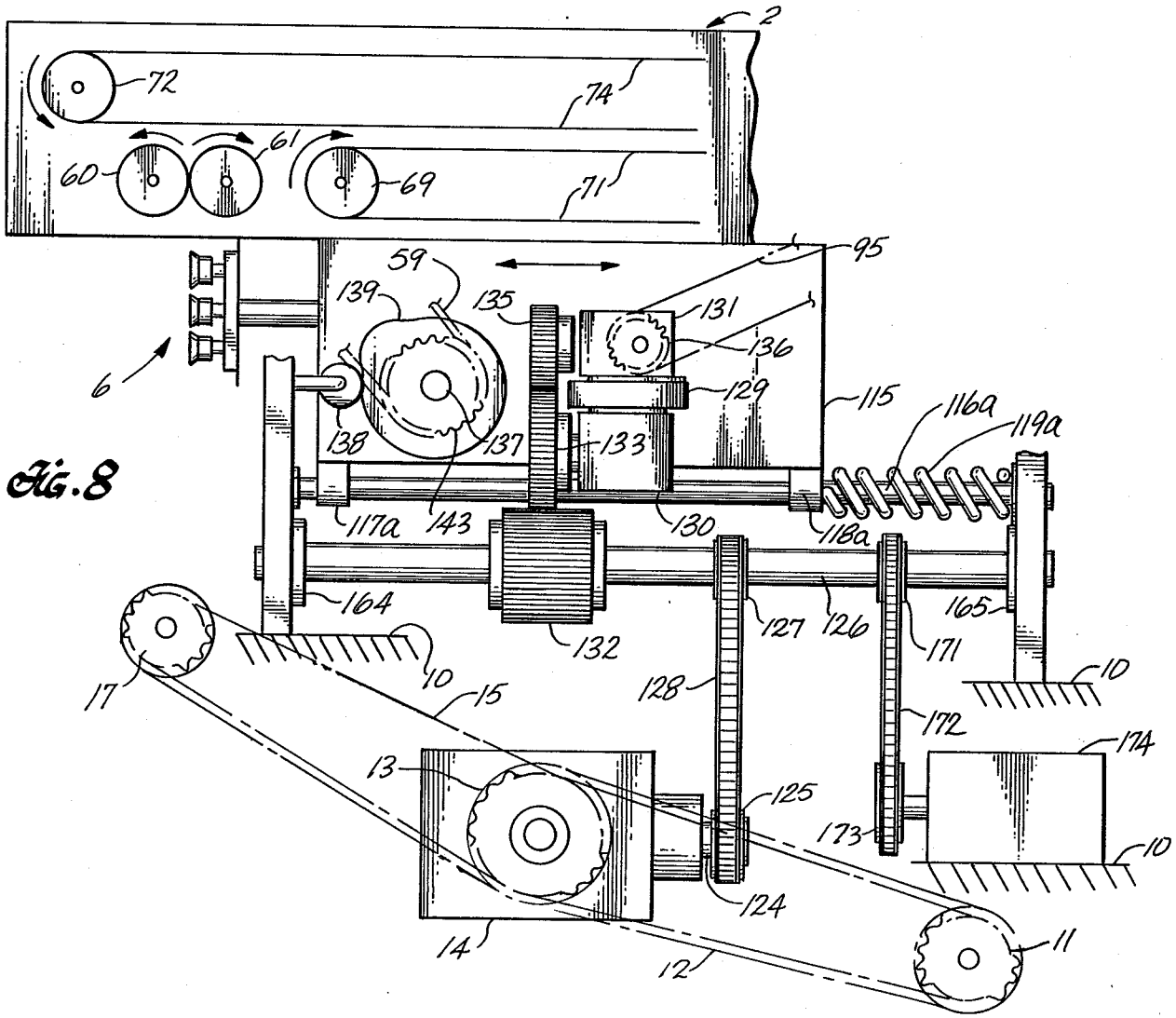
FIG. 8 is a schematic side view of the translatable carriage and the power transmission network of the apparatus without signatures.

As depicted in FIG. 8, a drive sprocket 11 coupled to the pin chain drive motor (not shown) is connected by a power transmission chain 12 to a drive sprocket 13. Drive sprocket 13 is mounted on the input shaft of a 90° gear box 14. Drive sprocket 13 is connected by a power transmission chain 15 to a drive sprocket 17.

Figure 3:
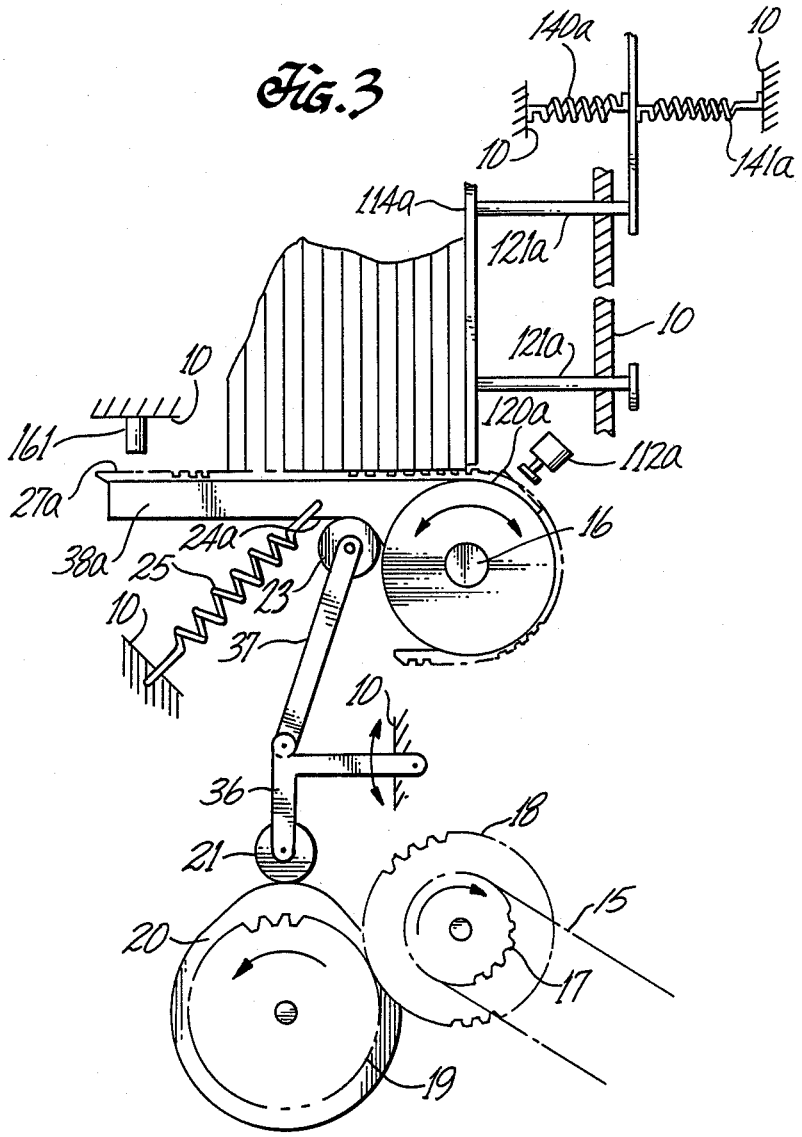
FIG. 3 is a schematic side view of the intermittent signature feed control mechanism.
Figure 4:
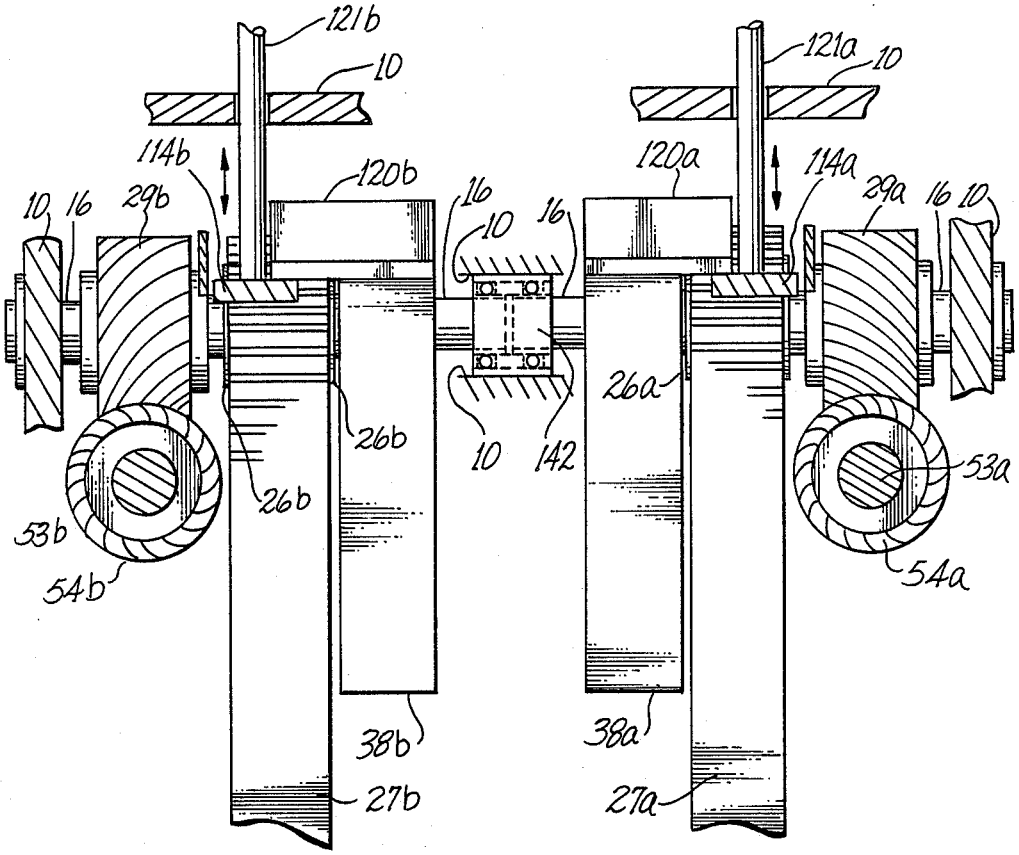
FIG. 4 is a schematic top view of the intermittent signature feed control mechanism of FIG. 3 without signatures.

As depicted in FIG. 3, at the end of feeder 1, adjacent to transfer station 2, a horizontal shaft 16 is mounted for rotation on frame 10 by bearings not shown. A sprocket 17 and a spur gear 18 are mounted on a common shaft rotatably supported by frame 10. Spur gear 18 meshes with a spur gear 19 mounted on a common shaft with a cam 20. A cam following roller 21, is rotatably mounted on one end of an arm 36 that is pivotally mounted to frame 10. One end of a linkage 37 is pivotally connected to arm 36 and a cam following roller 23 is mounted on the other end of arm 36. Cam surfaces 24a,24b on one-way mechanical clutches 38a,38b, which are mounted on shaft 16 are biased by springs 25a,25b to ride on roller 23. Clutches 38a,38b are conventional one-way mechanical clutches, such as for example, Torrington roller Clutch Part No. RCB-162117-FS. As shown in FIG. 4, pulleys 26a,26b and helical gears 29a,29b are also mounted on shaft 16. At the other end of feeder 1 from pulleys 26a,26b, pulleys 39a,39b (FIG. 2) are rotatably mounted on frame 10. Vertical shafts 53a,53b are rotatably mounted on frame 10 adjacent to transfer station 2. Pulleys 28a,28b and helical gears 54a,54b (FIG. 4) are mounted on shafts 53a,53b. Gears 54a,54b engage gears 29a,29b to transmit power to shafts 53a,53b. Near the middle of one side of feeder 1, a vertical shaft 113a is rotatably mounted on pivot arms 31, which are pivotably attached to frame 10 so shaft 113a pivots about the axis of rotation of shaft 53a. A vertical shaft 113b is rotatably mounted on frame 10 near the middle of the other side of feeder 1. Conveyor belts 32a are mounted on pulleys 28a and 30a. Conveyor belts 32b are mounted on pulleys 28b and 30b. Pivot arms 31 are biased by a spring 33 (FIG. 2) so as to urge belts 32a toward the side of stack 5. Colinear with belts 32b, a flat vertical signature guide 34 extends from the middle of feeder 1 to the end thereof adjacent to pulleys 39a,39b. Conveyor belts 27a,27b are mounted on pulleys 26a,26b and 39a,39b. When initially loading feeder 1 with signatures while the apparatus is at rest, carriage 31 is pivoted away from belts 27 to facilitate the insertion of signatures between belts 32a,32b. When the full length of belts 32a,32b is loaded with signatures by the attendant of the apparatus, carriage 31 is released so belts 32a bear against the signatures of the stack. Thereafter, during operation, as belts 27a,27b and belts 32a,32b feed signatures of stack 5 to transfer station 2, the attendant loads strapped signature bundles 7 onto belts 27a,27b to the left of pulleys 30a,30b up against guide 34 to align the vertical edges of all the signatures and in abutment with the signatures of stack 5. Each one of bundles 7 is carried by belts 27a,27b so it is between and engaged by belts 32a,32b and then the straps of that bundle are cut by the attendant so the individual signatures are separated from each other. As the loaded signatures are fed to transfer station 2 by belts 27a,27b and belts 32a,32b, new signature bundles 7 are loaded onto belts 27a,27b by the attendant and their straps are cut at the right time (i.e., when the bundle in question is engaged by belts 32a,32b) to maintain a continuous supply of signatures at transfer station 2.

In operation as sprocket 17, gears 18 and 19, and cam wheel 20 continuously rotate, rocker arm 36 reciprocates, thereby causing clutches 38a,38b to oscillate through a small angle, e.g., 20° or less. When clutches 38a,38b rotate in one direction, i.e., clockwise as viewed in FIG. 3, they engage shaft 16, which rotates with them. As clutches 38a,38b rotate in the other direction, i.e., counterclockwise, they slip with respect to shaft 16, which remains stationary. Thus, as sprocket 17 rotates continuously, shaft 16 rotates in one direction intermittently, pausing between increments of its rotational displacement. As a result, belts 32a,32b and belts 27a,27b intermittently feed signatures to transfer station 2.

Push plates 114a,114b and return bars 120a,120b automatically control the feeding increments introduced by clutches 38a,38b to accommodate different signature thicknesses. Push plates 114a,114b are secured to guide rods 121a,121b for reciprocal translational motion with respect to frame 10 in a direction parallel to signature feed 1. Springs 140a,140b and 141a,141b bias push plates 114a,114b , respectively, into a neutral position. Push plates 114a,114b lie in the path of signatures being fed into transfer station 2 so they are driven to the right as viewed in FIG. 3, i.e., toward transfer station 2. Return bars 120a,120b are attached to clutches 38a,38b, respectively, in the path of push bars 114a,114b as they move toward transfer station 2. Thus, as clutches 38a,38b rotte in the slipping (counterclockwise) direction under the influence of springs 25a,25b following a 0 feeding increment, return bars 120a,120b drive push plates 114a,114b up against the signature on the end of stack 5. The amount of this slipping rotation of clutches 38a,38b determines the amount of the next shaft engaging rotation of clutches 38a,38b in the opposite direction and therefore, the length of the signature feeding increment. The thicker the signatures, the greater the angle of slipping rotation required to return push plates 114a,114b to the signature on the end of stack 5 and the greater the length of the next feeding increment. If rotation of clutches 38a,38b in the slipping direction is inhibited, the signature feeding stops. Shaft 16 is split by a bearing 142 (FIG. 4), thereby permitting clutches 138a,138b to incrementally rotate the two sides of shaft 16 by different angular amounts. This compensates for differences in thickness on opposite sides of the signatures.

Figure 6:
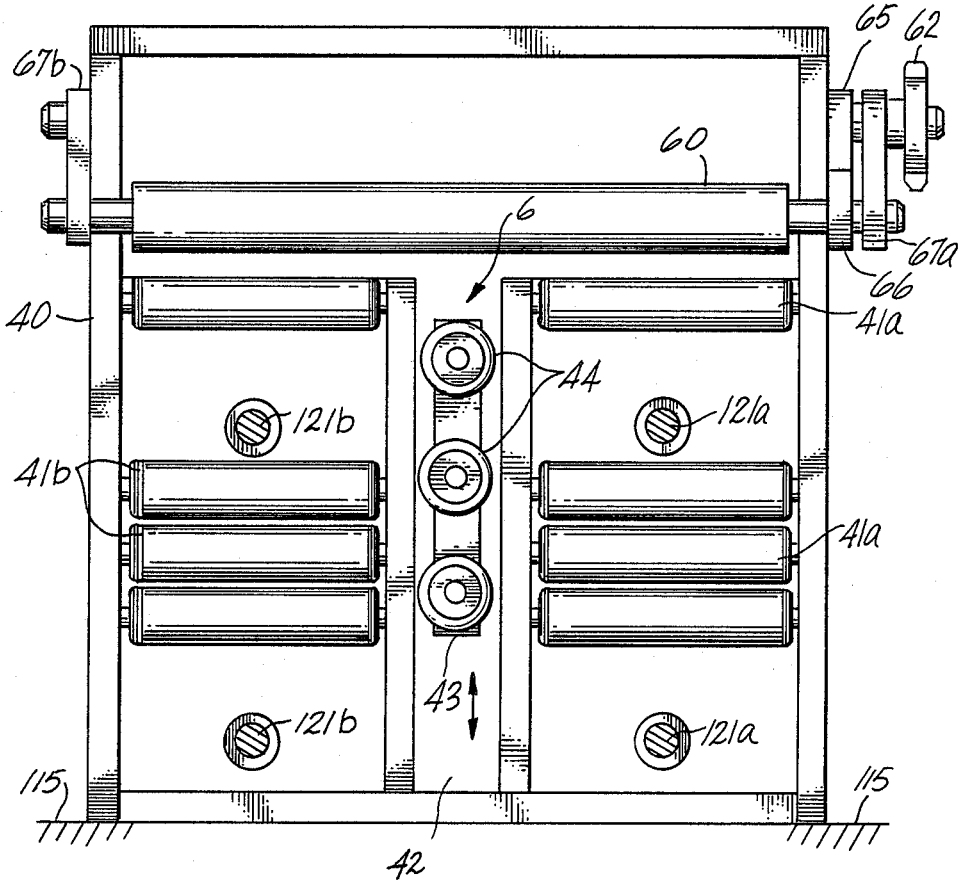
FIG. 6 is an end view of the transfer station of the apparatus of FIG. 1 without signatures taken through the plane indicated in FIG. 1.

At transfer station 2, a rectangular support 40 (FIG. 6) is fixedly mounted on carriage 115. Banks of idle rollers 41a,41b , are rotatably mounted on support 40 adjacent to the end of stack 5 so as to rotate about horizontal axes all lying in a common plane parallel to the plane of the signatures in stack 5. A vertically, elongated slot 42 is formed between idle rollers 41a and 41b to provide access to the signatures for transfer arm 6.

Figure 5:
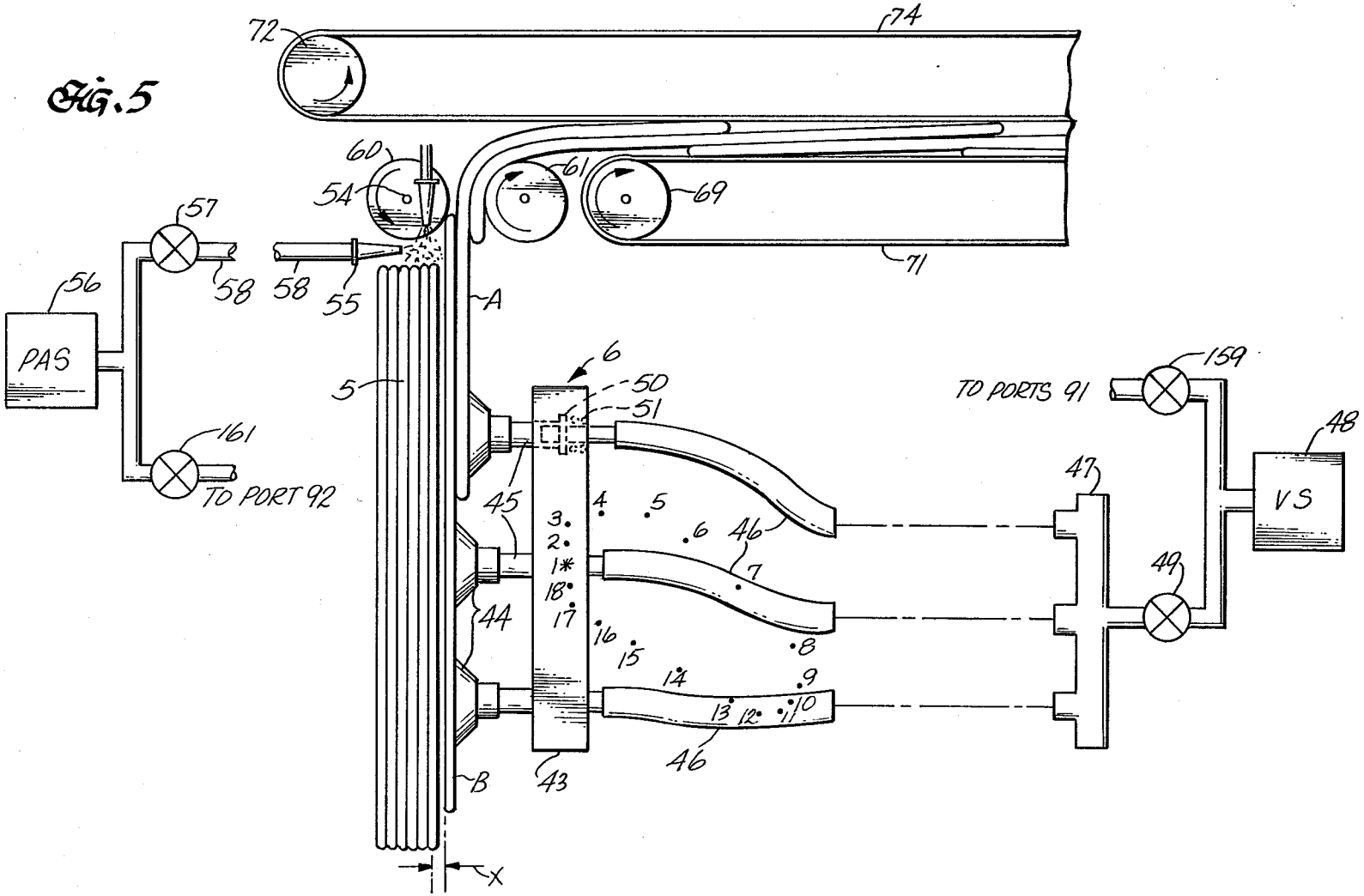
FIG. 5 is a schematic side view of the transfer arm, the conveyor, and the end of the stack of signatures carried by the transfer arm to the conveyor.

As shown in FIG. 5, transfer arm 6 comprises a housing 43 sized to fit within slot 42. Transfer arm is also mounted on carriage 115. Resilient vacuum cups 44 are mounted on hollow parallel stems 45 so as to extend from housing 6 toward stack 5. Three such vacuum cups are shown, but more or fewer may be provided so long as they are arranged to engage the face of the signature symmetrically with respect to the horizontal and vertical center lines of the signature face. This permits the vacuum cups to separate the signature to the same extent over substantially its entire face. Stems 45 are connected by flexible vacuum hoses 46 to the outlets of a manifold 47. A source of vacuum 48 is connected to the inlet of manifold 47 by a solenoid actuated normally closed, on/off valve 49. The ends of stems 45 each have a flange 50, which is urged by a compression spring 51 toward the signatures. The ends of hoses 46 extends into stems 45 to provide communication between suction cups 44 and vacuum source 48. As a result of springs 51, the positions of suction cups 44 are individually adjusted so they each make signature contact. Nozzles 54 and 55 are located at the top of stack 5 in the vicinity of transfer station 2. A source of pressurized air (PAS) 56 is connected to the inlets of nozzles 54 and 55 by a solenoid actuated normally closed on/off valve 57 and a hose 58. Functionally, PAS source 56 and valve 57 could comprise an electrical air blower that is turned on and off to start and stop the air stream. The outlet of nozzle 54 is directed to eject a stream of pressurized air downwardly as viewed in FIG. 5 toward the contacting surfaces of adjacent signatures. The outlet of nozzle 55 is directed to eject a stream of pressurized air along the top of stack 5 from left to right as viewed in FIG. 5.

Conveyor 3 includes a pair of pinch rollers 60 and 61. Pinch roller 60 is located directly above the top of stack 5 and pinch roller 61 is located at the same elevation as pinch roller 60, a short distance to the right thereof as viewed in FIG. 5. Pinch rollers 60 and 61 are rotatably mounted on support 40. A drive sprocket 62 (FIG. 7) is rotatably mounted on support 40. Power is transmitted by a chain 59 to drive sprocket 62 in the manner described hereinafter. A gear 63, which engages a gear 64 on the end of pinch roller 61, is connected to drive sprocket 62 to transmit power to roller 61. A gear 65, which is rotatably mounted on support 40, engages gear 63. Gear 65 engages a gear 66 on the end of pinch roller 60, to transmit power to roller 60. The ends of pinch roller 60 are rotatably mounted on a three-sided 5 rack 67, which is pivotally mounted on support 40 to pivot about the axis of rotation of gear 65. Rack 67 is biased by springs 68*a*,68*b* to urge pinch roller 60 toward pinch roller 61, which accommodates variations in signature thickness. A microswitch 181 is mounted on support 40 in the path of rack 67 as pinch roller 60 pivots away from pinch roller 61. A roller 69 is rotatably mounted on support 40 adjacent to pinch roller 61 at the same elevation as pinch rollers 60 and 61. Near gathering track 4, a roller 70 is rotatably mounted on support 40 at the same elevation as roller 69. A conveyor belt 71 is mounted on rollers 69 and 70. A roller 72 is rotatably mounted on support 40 over stack 5 and above pinch rollers 60 and 61. A roller 73 is rotatably mounted on support 40 above roller 70 at the same elevation as roller 72. Conveyor belts 74 are mounted on rollers 72 and 73. Gear 65 also engages a gear 76 on the end of roller 72 to transmit power from drive sprocket 62 to roller 72. A gear 77 on the end of roller 69 and gear 64 both engage a gear 79 rotatably mounted on support 40 therebetween to transmit power to roller 69. The gear ratios of the described gears are selected so chain 59 drives pinch rollers 60 and 61 and conveyor belts 71 and 74 at the same linear speed.

Figure 10:
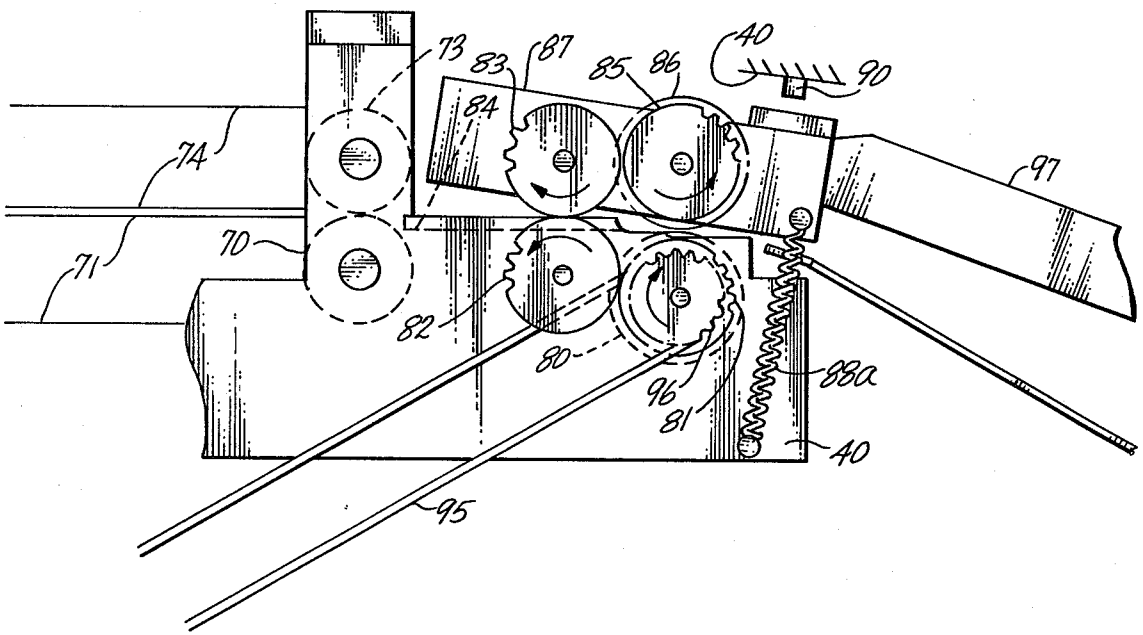
FIG. 10 is a side view of a portion of the exit of the conveyor without signatures.

A pinch roller 80 is rotatably mounted on support 40 slightly below and to the right of roller 70, as viewed in FIGS. 1 and 10. The periphery of roller 80 protrudes upwardly from below through a transverse slot in a horizontal signature support platform 84. Power is transmitted by a chain 95 to a drive sprocket 96 in the manner described below. Sprocket 96 and a gear 81 are mounted on the same shaft as pinch roller 80 outboard of support 40. Gear 81 engages a gear 82 rotatably mounted on support 40. A pinch roller 86 is rotatably mounted on a three-sided rack 87, which is itself mounted on support 40 to pivot about an axis that locates pinch roller 86 above pinch roller 80. Gear 82 engages a gear 83 rotatably mounted on rack 87 to rotate about the pivot axis thereof. A gear 85, which is mounted on the end of pinch roller 86 outboard of support 40, engages gear 83. Compression springs 88*a*,88*b* are connected between rack 87 and support 40 to urge pinch roller 86 toward pinch roller 80. Pinch rollers 60 and 61 define the entrance of conveyor 3 and pinch rollers 80 and 86 define the exit from conveyor 3. A microswitch 90 is mounted on support 40 in the path of rack 87 as pinch roller 86 pivots away from pinch roller 80. The gear ratios of the described gears are selected so the linear speed of pinch rollers 80 and 86 is greater than that of pinch rollers 60 and 61 and conveyor belts 71 and 74.

Figure 11:
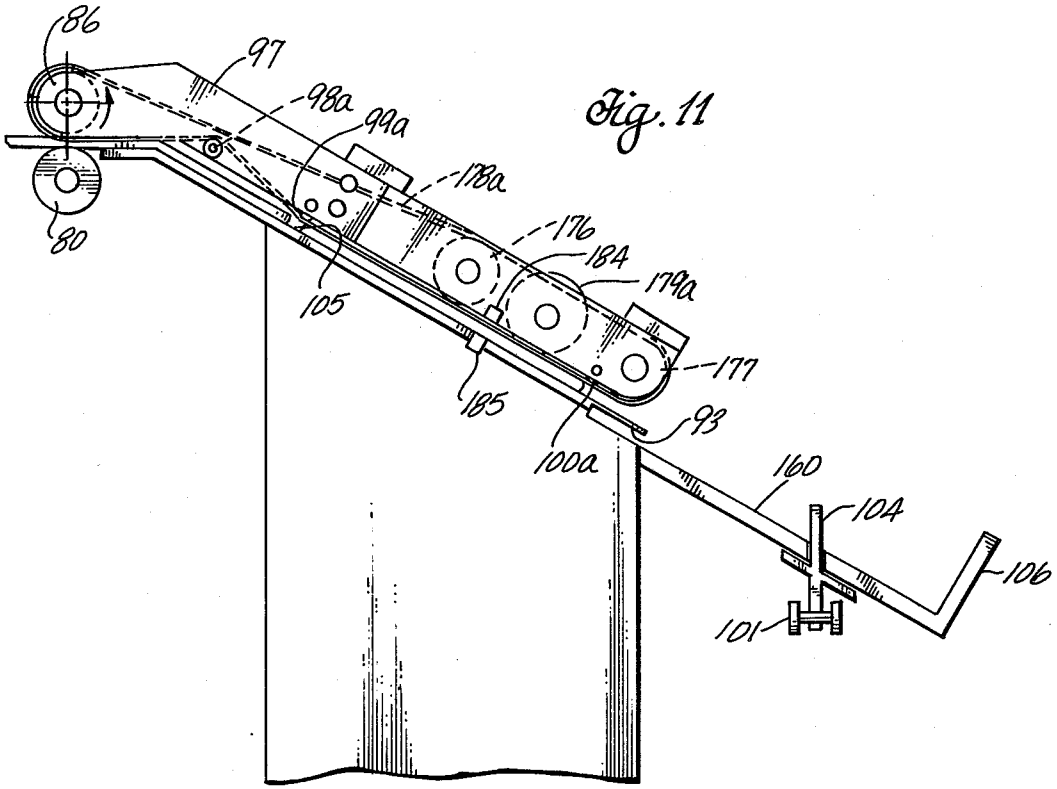
FIG. 11 is a side view of the remainder of the conveyor exit and one station of the gathering track.

A stationary downwardly sloped platform 105 leads from pinch rollers 80 and 86 to gathering track 4. Near its upper end, platform 105 has laterally spaced apart vacuum ports 91 (FIG. 12) discussed below. Vacuum source 48 is connected to ports 91 by a solenoid actuated on/off valve 159 (FIG. 5). Near the lower end, platform 105 has an air supply port 92 (FIG. 12), also discussed below. Pressurized air source 56 is connected to port 92 by a solenoid actuated on/off valve 161 (FIG. 5). Platform 105 has an overhanging downward step 93 at its lower end (FIG. 11). Overlying platform 105, is a three-sided rack 97. Rack 97 is mounted on rack 87 (FIG. 10) to pivot about the rotational axis of roller 86. Pulleys 98*a*,98*b*, pulleys 99*a*,99*b*, pulleys 100*a*,100*b*, and rollers 176 and 177 are mounted on rack 97 to rotate about axes parallel to its pivot axis. Conveyor belts 178*a*,178*b* are guided between rollers 86 and 177 in a path defined by pulleys 98*a*,98*b*, pulleys 99*a*,99*b* pulleys 100*a*,100*b*, and roller 176. Roller 86 drives conveyor belts 178*a*,178*b* to control the linear speed of signatures traveling down platform 105. Wheels 179*a*,179*b* are mounted on frame 97 to permit it to roll on platform 105 as carriage 115 moves back and forth.

Reference is made to FIG. 5 for a description of the operation of transfer arm 6, which travels in a tilted D-shaped path. For the purpose of this description, the operating cycle of the apparatus, i.e., the transport interval of one signature from stack 5 to conveyor 3, is divided into 18 increments of 20° each. The path that a reference point on transfer arm 6 designated by a star follows during the 18 increments is depicted by a series of 18 numbered dots. Transfer arm 6 is shown at increment 1 in FIG. 5. During an operating cycle, transfer arm 6 is driven from each increment to the next higher numbered increment by a path control mechanism described below in connection with FIG. 9. Between increments 17 and 3, transfer arm 6 moves vertically upward as viewed in FIG. 4 with suction cups 44 engaging two signatures of stack 5 at transfer station 2. (Preferably, there is no horizontal component to the movement of transfer arm 6 during this interval.) As illustrated in FIG. 5, transfer station 2, conveyor 3 and stack 5 are so positioned relative to each other that when transfer arm 6 moves into engagement with a signature B at the end of stack 5, the preceding signature A engaged by transfer arm 6 at the end of stack 5 is being transported by rollers 60 and 61 of conveyor 3. Specifically, the uppermost suction cup 44 engages signature A fully positioned between pinch rollers 60 and 61 while the lower two suction cups 44 engage signature B being moved from the end of stack 5 into pinch rollers 60 and 61. The vertical length L of the path of transfer arm 6 is sufficiently long to carry each signature in turn from stack 5 to the nip of rollers 60 and 61. Suction cups 44 are so positioned that at least one of them engages signature A and one of them engages signature B between increments 17 and 3. As previously described, suction cups 44 are spring loaded to accommodate the difference in the distance between the signatures they engage, i.e., signatures A and B, and housing 43 of transfer arm 6.

Figure 17:
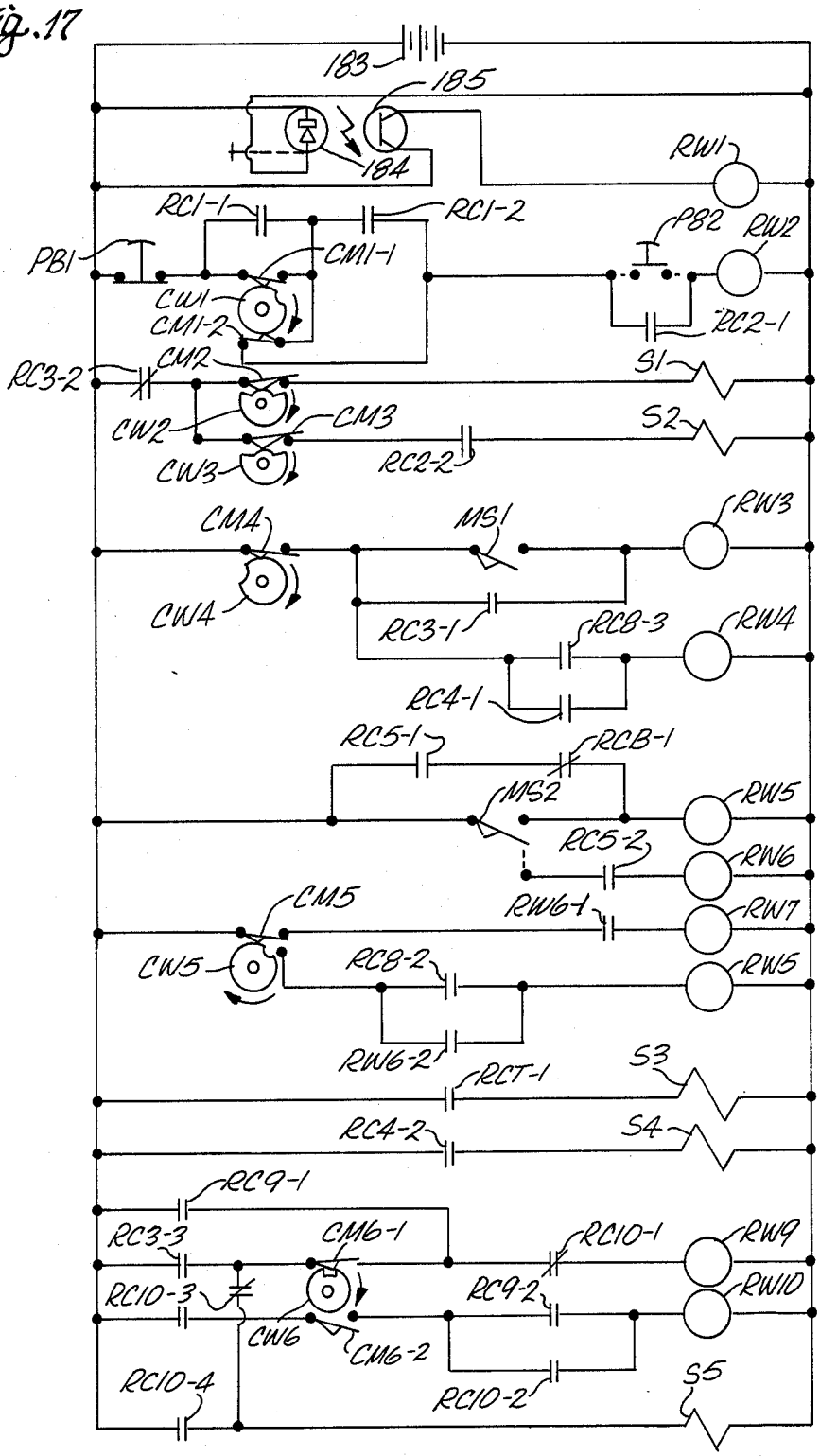
FIG. 17 is a schematic diagram of the control circuitry for operating the apparatus.
Figure 18:
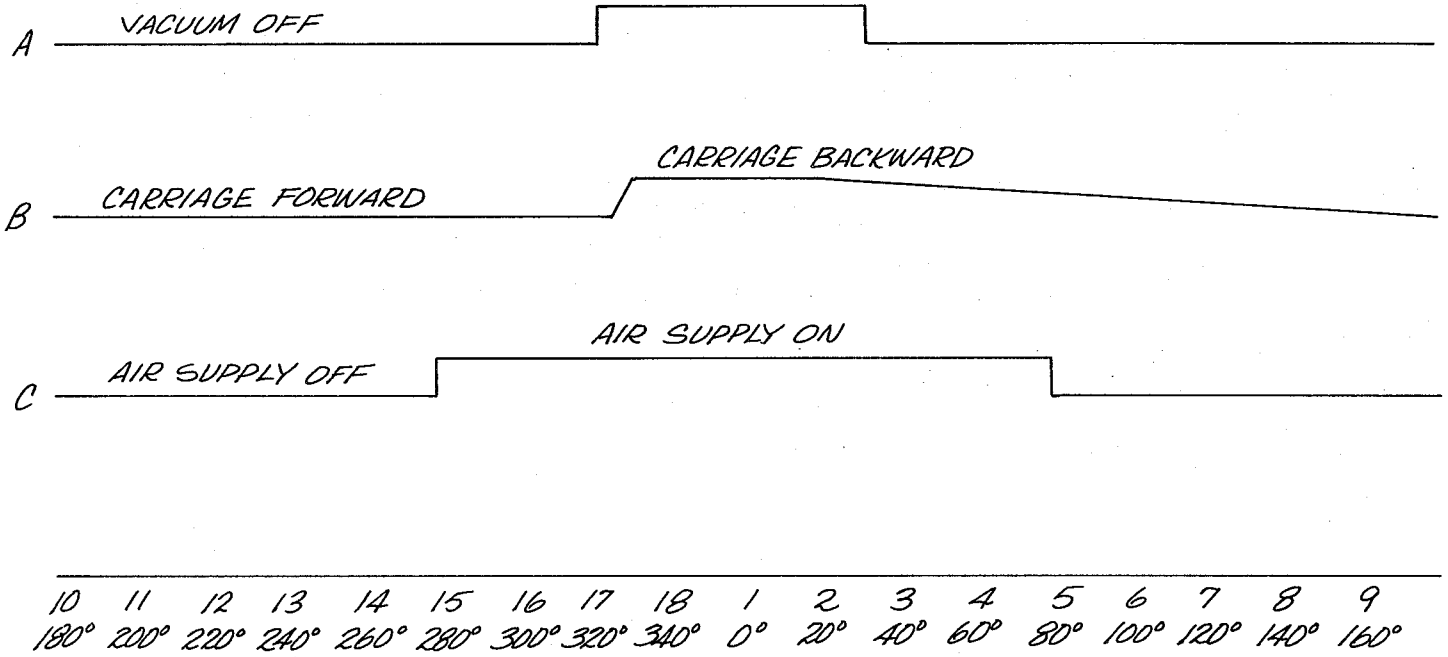
FIG. 18 is a timing diagram representing the timing relationship among the parts of the apparatus.

FIG. 18 shows timing diagrams of the apparatus during the 18 increments of one cycle. As shown by diagram A, at increment 17, valve 49 is opened and vacuum is applied, i.e., turned on, to suction cups 44 between increments 2 and 3, valve 49 is closed to cut off the supply of vacuum to suction cups 44. At increment 3, transfer arm 6 begins to move away from stack 5 and continues to move away from stack 5 and in a downwardly direction until increment 11. At increment 11, transfer arm 6 begins to move upwardly and back toward stack 5 until increment 17, at which time the described cycle is repeated. Prior to increment 17, e.g., during increments 12 to 16, transfer arm 6 moves in an upwardly direction as it approaches stack 5. This reduces the relative speed between the uppermost suction cup 44 and signature A, which is moving upwardly at this time at a rapid speed, and thus reduces the friction between the signatures and suction cups 44, thereby effecting a smooth signature pickup and discouraging mutilation of the signatures as they are carried to conveyor 3. Preferably, the vertical component of the approach speed of transfer arm 6 during increments 12 to 16, and the vertical speed of transfer arm 6 during engagement with the signatures (in increments 17 to 3) is approximately the same as the linear speed of pinch rollers 60 and 61 and conveyor belts 71 and 74. This also promotes a smoother signature pickup and delivery to conveyor 3. Three measures are employed to separate the signature being carried to conveyor 3, namely signature B, from the remainder of stack 5, as represented by space X in FIG. 5. First, immediately after vacuum is applied to suction cups 44 at increment 17, as shown in FIG. 17 by diagram B, carriage 115 and thus transfer arm 6 are moved backward a small distance away from stack 5, i.e., to the right as viewed in FIG. 5, by a retract mechanism described in detail below in connection with FIG. 8 to create spacing X, which maybe dissipated by the pressure of stack 5. Assuming a signature thickness of ¼ of an inch, the carriage retraction, and thus spacing X, is about ¼ inch. Then, the carriage gradually returns to its forward position between increments 2 and 9. Second, as shown in FIG. 17 by diagram C, valve 57 is opened at increment 15 to direct air under pressure against the surface of signature B facing toward the remainder of stack 5. This air flow between signature B and the remainder of stack 5 helps maintain spacing X therebetween. Third, the transport of stack 5 on feeder 1 is interrupted by clutches 38*a*,38*b* between increments 15 and 6, more or less, depending upon the signature thickness. Although it is preferable to employ all three of the described measures, the invention contemplates that under some circumstances, one or two of these measures could be employed to separate the signature being carried to conveyor 3 to the exclusion of the other measures. In summary, each signature in turn is separated from stack 5 and carried by transfer arm 6 to conveyor 3. The transport speed of conveyor 3 relative to the repetition rate of transfer arm 6 is such that each signature lies in overlapping relationship with the previously transferred signature. The engagement of two shingled signatures by transfer arm 6 during each cycle of its operation — one signature being transported between pinch rollers 60 and 61 and another signature being removed from stack 5 —reduces the strength of the vacuum required to remove the signatures from the stack by as much as 50%, e.g., from 20 inches to 10 inches Hg. In essence, pinch rollers 60 and 61, assist transfer arm 6 in accelerating the signature being removed from the stack because the two signatures are simultaneously engaged by the vacuum cups of transfer arms 6 and thereby coupled together. A reduction in the strength of the vacuum is desirable because the tendency of the vacuum cups to pick up double signatures is diminished and less time is required for vacuum buildup to the desired subatmospheric pressure, thereby permitting the apparatus to run at a higher speed.

Conveyor 3 carries the transferred signatures as a moving, shingled, i.e., overlapping, stream toward gathering track 4. Specifically, pinch rollers 60 and 61 feed the moving stream of signatures between belts 71 and 74, which transport the moving stream of signatures to pinch rollers 80 and 86. Pinch rollers 80 and 86 run at a substantially higher linear speed than pinch rollers 60 and 61 and belts 71 and 74. Specifically, the speed of pinch rollers 80 and 86 is sufficiently high to completely separate the signatures of the moving stream one from the other. In a typical case, there would be a four-inch overlap in the stream of signatures passing between pinch rollers 60 and 61 and conveyor belts 71 and 74 and a four-inch separation between signatures leaving pinch rollers 80 and 86 resulting from an increased linear transport speed of about 2½ times from conveyor belts 71 and 74 to pinch rollers 80 and 86.

With reference to FIG. 8, carriage 115 rides on cylindrical rails 116*a*,116*b*, which are fixed to frame 10. Bearing housings 117*a*,117*b* and bearing housings 118*a*,118*b* are formed on the bottom of carriage 115. Linear bearings, not shown, contained in housings 117*a*,117*b* and housings 118*a*,118*b* support carriage 115 on rails 116*a*,116*b*. Compression springs 119*a*,119*b* are mounted on rails 116*a*,116*b* between a vertical portion of frame 10 and housings 118*a*,118*b* to urge carriage 115 to the left as viewed in FIG. 8 toward transfer station 2. Gear box 14 has an output shaft 124 on which is mounted a drive sprocket 125. A shaft 126 is journaled for rotation by bearings 164 and 165 on frame 10 about an axis parallel to the direction of movement of carriage 115. A drive sprocket 127 is fixed on shaft 126. A power transmission chain 128 extends between sprockets 125 and 127. A thick spur gear 132 is also fixed on shaft 126. A platform 129 is secured to the side of carriage 115. A right angle gear box 130 is secured to the bottom of platform 129 and a right angle gear box 131 is secured to the top of platform 129. A thin spur gear 133 that engages spur gear 132 is secured to the input shaft of gear box 130. As carriage 115 moves on rails 116*a*,116*b*, spur gear 133 maintains engagement with spur gear 132 because of the difference in thickness. A thin spur gear 135 that engages spur gear 133 is secured to the input shaft of gear box 131. A drive sprocket 136 is mounted on the output shaft of gear box 131. Chain 95 transmits power from drive sprocket 136 to drive sprocket 96 (FIG. 10).

Figure 7:
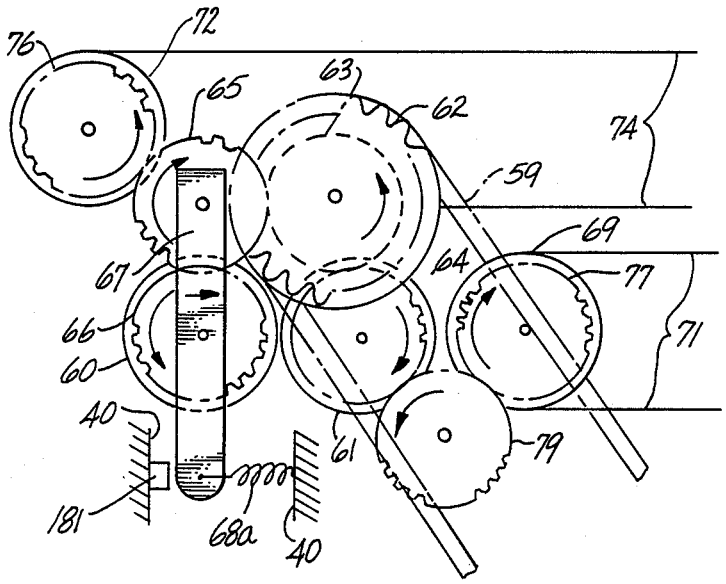
FIG. 7 is a schematic side view of part of the power transmission network at the entrance of the conveyor without signatures.

As explained in detail below in connection with FIG. 9, the output shaft of gear box 130 extends into the interior of carriage 115, where it drives the path control mechanism for transfer arm 6. A rotatable shaft 137, which is coupled to the output shaft of gear box 130 through gearing described in connection with FIG. 9, extends outside carriage 115. A drive sprocket 143 and a cam wheel 139 are fixed on shaft 137. Chain 59 transmits power from sprocket 143 to sprocket 62 (FIG. 7). Cam wheel 139 is urged by springs 119*a*,119*b* against a cam follower wheel 138 mounted for rotation on frame 10. The contour of cam wheel 139 causes carriage 115 to reciprocate on rails 116*a*,116*b* in the manner illustrated by diagram B of FIG. 7 — rapidly moving carriage 115, and thus transfer arm 6, backward away from stack 5 immediately after transfer arm 6 engages a new signature in the described manner, and then slowly returning carriage 115 to its forward position after transfer arm 6 releases the signatures. Thus, cam follower 138 and cam wheel 139 function as the retract mechanism referred to above in connection with the description of the operation of transfer arm 6.

Figure 9:
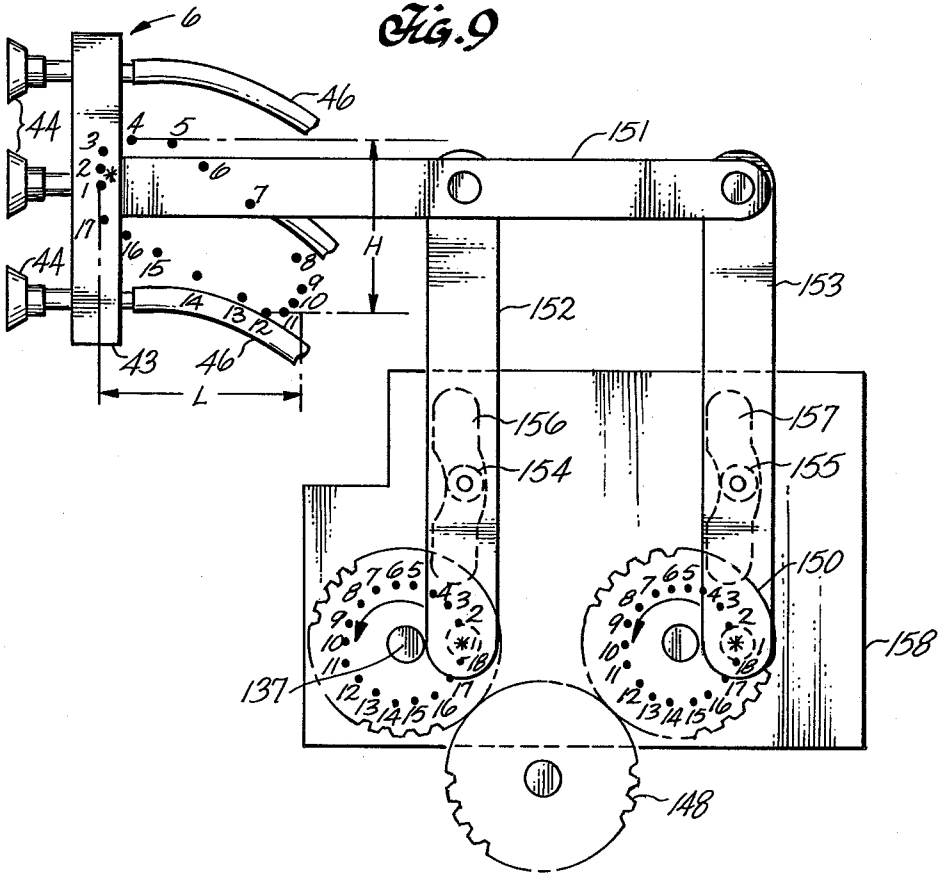
FIG. 9 is a side view of the transfer arm path control mechanism.

As shown in FIG. 9, inside carriage 115 spur gear 148 engages rotatably mounted spur gears 149 and 150. The axes of rotation of spur gears 148, 149, and 150 are all perpendicular to the direction of movement of carriage 115. Spur gear 148 is fixed on the output shaft of gear box 130. Spur gear 149 is fixed on shaft 137 (FIG. 8). Housing 43 of transfer arm 6 is connected to one end of a carrier arm 151. The longitudinal axis of arm 151 is parallel to the plane in which the axes of rotation of gears 149 and 150 lie. One end of a connector arm 152 is rotatably attached to gear 149 and the other end thereof is rotatably attached to arm 151. Similarly, one end of a connecting arm 153 is rotatably attached to gear 150 and the other end of arm 153 is rotatably attached to arm 151. Arms 152 and 153 are equal in length and the distance between their points of attachment to gears 149 and 150 equals the distance between their points of attachment to arm 151. Thus, arms 151, 152, and 153 form three sides of a parallelogram. Cam follower wheels 154 and 155, which are rotatably mounted on arms 152 and 153, respectively, ride in slots 556 and 157, respectively, in a stationary guide plate 158. The shape of slots 156 and 57 defines the path of movement of transfer arm 6. Specifically, as the starred points on gears 149 and 15 pass each of the 18 increments designated in FIG. 9, the starred point on transfer arm 6 passes the corresponding increment of its path designated in FIG. 9. The described arrangement comprises the path control mechanism referred to above.

With reference to FIG. 8, shaft 126 carries a drive sprocket 171, which is coupled by a power transmission chain 172 to a drive sprocket 173. Sprocket 173 drives the shaft of a control box 174. In control box 174, two cams wheels (not shown) are mounted on the shaft. These cam wheels together with cam wheel 20 (FIG. 3) and cam wheel 139 (FIG. 8), control the timing of the operation of the apparatus. One cam wheel in control box 174 actuates, i.e., opens and closes, valve 57 to turn the air supply to nozzles 54 and 55 on and off. The remaining cam wheel actuates, i.e., turns on and off, valve 49 to turn on and off the vacuum of suction cups 44. The cam wheels are so shaped and oriented on the shaft as to satisfy timing diagrams A, B, and C of FIG. 18.

With reference to FIGS. 1, 2, 11, 12, 13, 14, and 15, gathering track 4 has a plurality of signature-receiving stations, one corresponding to each unit of the described apparatus. The heart of gathering track 4 is a long endless pin-carrying chain 101 extending between by sprockets 102 and 103 so chain 101 moves transverse to the direction of travel of conveyor 2 past each unit of the described apparatus. Chain 101 and sprockets 102 and 103 all lie in a horizontal plane. Sprockets 102 and 103 are mounted to rotate about vertical axes. Upwardly extending upright pins 104 are fixed on chain 101 at intervals corresponding to the spacing between stations and power from a pin chain drive motor 8 is transmitted to sprockets 102 and 103. As a result, as chain 101 moves around sprockets 102 and 103, pins 104 move across each station in synchronism with the signatures delivered by the described apparatus. At each station, gathering track 4 has a stationary, downwardly and forwardly (i.e., in the direction of signature transport) sloping platform 105. Adjacent to conveyor 3, a platform 160 is attached to platform 105. At the opposite edge of platform 160 is formed a flange 106, which serves as a stop for signatures sliding down platform 160 from conveyor 2. Under platform 160, a single elongated platform 107 extends over the full length of gathering track 4, including each unit of the described apparatus. Platforms 160 and platform 107 have longitudinal continuous slots 108 and 109, respectively, through which pins 104 extend as they move across each station. A signature 110 delivered by each unit of the described apparatus to a corresponding station of gathering track 4 first slides down platform 105 to stop 106 and then is carried by pin 104 in a forward direction to platform 107, where it lands on top of a stack 111 comprising signatures from each of the previous stations of gathering track 4. Pins 104 transport stacks 111 along platform 107 to the end of gathering track 4, from which stacks 111 are taken to a binding station that is not part of this invention.

Since the described apparatus is driven from the pin chain of gathering track 4, the operation thereof is synchronized to the gatherer, one signature being supplied for each pin pass. When double signatures are picked up by transfer arm 6, this condition is detected by rack 67, which then actuates microswitch 181 (FIG. 7). On the very next cycle, valve 49 (FIG. 5) does not open so no vacuum is applied to suction cups 44 and the arms of air cylinders **112*a*,112*b* are extended to prevent clutches 38*a*,38*b* from returning to their counterclockwise position. As a result, no signature is picked up by transfer arm 6 in the position immediately following the double signature and no incremental signature feed takes place. In other words, a missing signature is intentionally created in the position immediately following the double signature. When the double signatures are again detected at the exit of conveyor 2 when rack 187 actuates microswitch 90 (FIG. 10), vacuum is applied to vacuum ports 91, thereby holding the lower one of the double signatures for one complete cycle, while the upper one continues to be transported by conveyor belts 178*a*,178*b***. As a result, the bottom one of the double signatures is in effect shifted back to fill the missing signature position. In this way, a double signature condition can be corrected without interrupting operation of the apparatus.

A light-emitting diode 184 is mounted on rack 97 and a phototransistor 185 is mounted flush with the surface of platform 105 in alignment with diode 184 (FIG. 11). When a missing signature is detected by the phototransistor, in a signature position or a signature is detected in the space between signature positions, the apparatus is shut down. Because of the reliability of operation of transfer arm 6, however, missing signatures are much rarer than double signatures so interruption of the operation of the apparatus is infrequent.

The relative number of double signatures and missed signatures can be controlled by the strength of the vacuum of suction cups 44 and the spring constants of springs **140*a*,140*b* and springs 141*a*,141*b*. Reducing the vacuum strength produces more misses and increasing the vacuum strength produces more double signatures. Reducing the spring constant of or eliminating springs 140*a*,140*b* produces more missed signatures. Reducing the spring constant of or eliminating springs 141*a*,141*b*** produces more double signatures. In general, the vacuum and spring constants are adjusted to produce more double signatures than missed signatures because the former can be corrected without interrupting operation.

To provide the maximum possible time for each signature entering a signature-receiving station to stabilize prior to engagement by a pin 104, the linear speed of pinch rollers 80 and 85 and conveyor belts 78a,78b is designed to be greater than the linear speed of chain 101. Preferably, the difference in linear speed is about one-half of the spacing between signatures on gathering track 4. For example, if the space between pins 104 is 20 inches and the signature length is 11½ inches, the spacing between signatures on gathering track 4 is 8½ inches and the linear speed of pinch rollers 80 and 85 and conveyor belts 178a,178b (and the spacing between signatures on platform 105) is about 4 inches greater than the linear speed of chain 101. In addition, the phasing of the delivery of signatures to the signature-receiving stations is such that the leading edge of the arriving signature grazes pin 104 about to leave that signature-receiving station. Step 93 (FIG. 11) causes the arriving signature to overlap rather than abut the signature leaving the station.

The control circuitry of FIG. 17 employs relay windings with a preface "RW," relay contacts with a preface "RC" and the same suffix as the relay winding by which they are controlled, cam wheels with a preface "CW," cam-operated microswitches with a preface "CM" and the same suffix as the cam wheel by which they are controlled, manually operated push button switches with a preface "PB," microswitches with a preface "MS," and actuating solenoids with a preface "S."Normally closed relay contacts are represented by two parallel vertical lines with a diagonal line therebetween and normally open relay contacts are represented by two parallel vertical lines without a diagonal line. The control circuitry is energized by a source of 110-volt AC line power 183. Light-emitting diode 184 (FIG. 11) is connected across power source 183. Photo transistor 185 (FIG. 11) and a relay winding RW1 are connected in series across power source 183. In the absence of a signature between diode 184 and transistor 185, transistor 185 conducts and relay winding RW1 is energized. Cam wheels CW1, CW2, CW3, CW4, CW5, and CW6 are all disposed in cam box 174 on a shaft that is driven by prime mover 8 in synchronism with the pin chain so as to properly phase the operation of the described apparatus.

While relay winding RW2 is energized, motor 8 is operating. Cam wheel CW1 has a narrow notch that briefly opens microswitches CM1-1 and CM1-2 at 180° intervals during each cycle of the apparatus. If a,signature is missing when microswitch CM1-1 opens, a contact RC1-1 is also open and relay winding RW2 becomes deenergized, thereby stopping the operation of motor 8. Similarly, if a signature is improperly positioned between diode 184 and transistor 185 when microswitch CM1-2 opens (there should be a space between signatures) contact RC1-2 is also open and relay winding RW2 becomes deenergized. Operation of motor 8 can be manually terminated at any time by depressing a push button PB1. After termination of operation, motor 8 can be manually restarted by depressing a push button PB2.

A microswitch CM2 of cam wheel CW2 is connected in series with an actuating solenoids 1, which controls valve 49 (FIG. 5). Cam wheel CW2 has a wide notch corresponding in width to the "vacuum on" time shown in diagram A of FIG. 18. When microswitch CM2 is closed by cam wheel CW2, solenoid S1 is energized and valve 49 opens.

A microswitch CM3 of cam wheel CW3 is connected in series with an actuating solenoid S2, which controls valve 57 (FIG. 5). Cam wheel CW3 has a wide notch corresponding in width to the "air supply on" time shown in diagram C of FIG. 18. When a microswitch CM3 is closed by cam wheel CM3, solenoid S2 is energized and valve 57 opens.

When transfer arm 6 picks up a double signature, microswitch 181 (FIG. 7), which is represented as microswitch MS1, is closed by the separation of pinch rollers 60 and 61. Solenoid S5 actuates a valve that supplies air to air cylinders 112a,112b (FIG. 3), thereby extending their arms to prevent clutches 38a,38b from rotating in the slipping direction. When relay winding RW3 is energized, solenoid S5 is energized by contacts RC3-3 and RC10-3, and relay winding RW3 is latched by contact RC3-1. Cam wheel CW4 has a narrow notch which opens microswitch CM4 briefly once each cycle, thereby deenergizing relay RW3 after one cycle. While relay RW3 is energized, contact RC3-2 deenergizes solenoids S1 and S2, thereby preventing application of vacuum to suction cups 44 and the supply of air to the signature about to be separated from the stack. As previously described, this creates a missing signature in the position immediately following the double signature.

A cam wheel CW6 has a narrow notch that closes microswitches CM6-1 and CM6-2. While relay winding RW3 is energized, microswitch CM6-1 closes briefly to energize relay winding RW9, which is latched by relay contact RC9-1. After relay winding RW9 is energized, relay winding RW10 becomes energized by microswitch CM6-2 and contact RC9-2. As a result, winding RW9 is deenergized by contact RC10-1. Winding RW10 remains energized for one cycle until microswitch CM6-2 opens thereby also deenergizing solenoid S5 by contact RC10-4.

Figure 12:
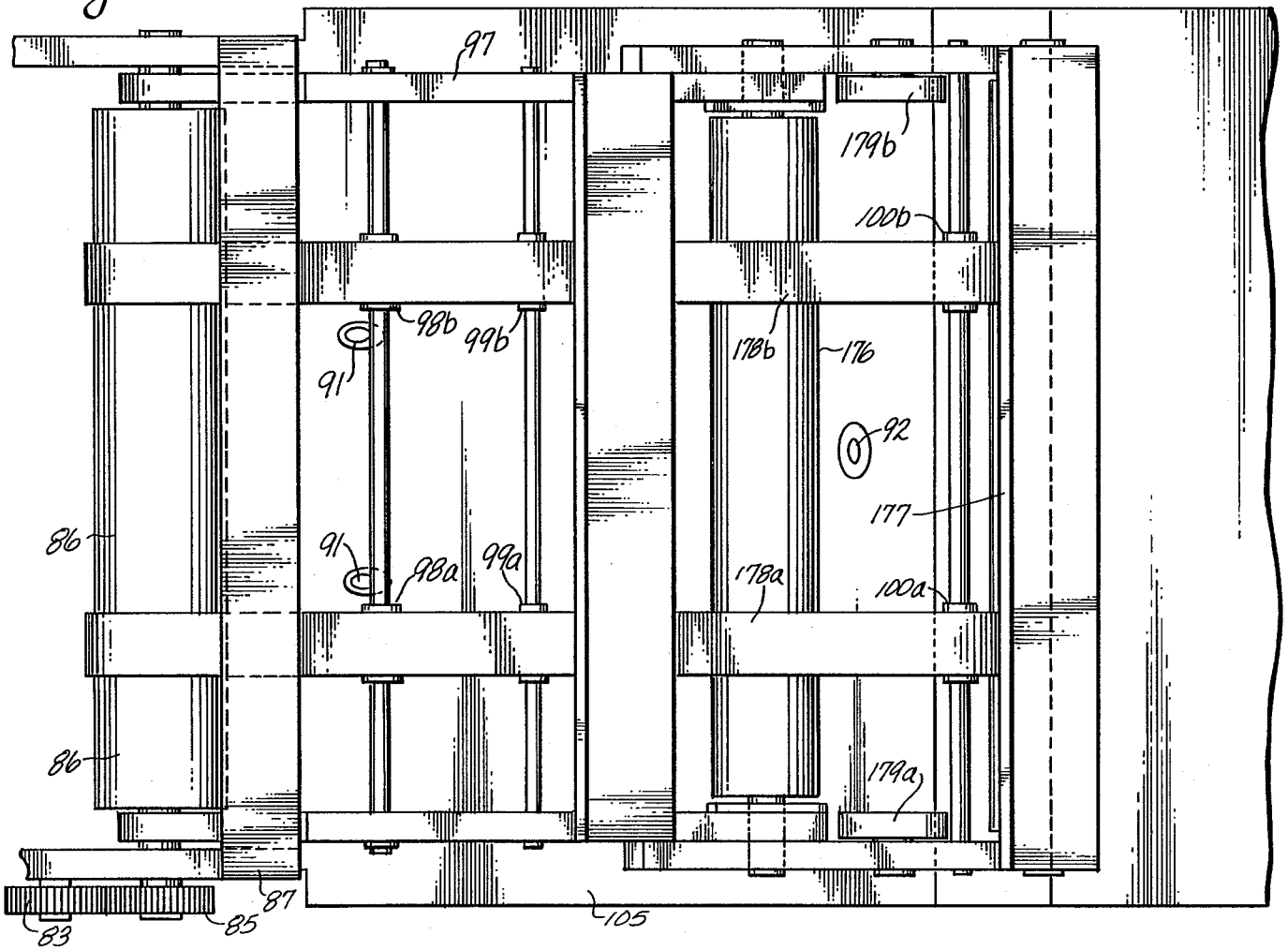
FIG. 12 is a top plan view of the conveyor exit without signatures.

When the double signature reaches the exit of conveyor 2, microswitch 90 (FIG. 10), which is represented as microswitch MS2, is actuated by the separation of pinch rollers 80 and 85. As a result, relay winding RW5 is energized and latched through contacts RC5-1 and RC8-1. Upon deactuation of microswitch MS2, relay winding RW6 is energized through contact RC5-2. This causes relay relay RW7 is energized, solenoid S3 is energized by contact RC7-1 for one cycle to open valve 159 (FIG. 5), which supplies vacuum to ports 91 (FIG. 12). Cam wheel CW5 has a narrow notch that deactuates microswitch CM5 and thereby deenergizes relay winding RW7 after one cycle while energizing relay winding RW8. When relay winding RW8 is energized, relay winding RW8 is latched by contact RC8-2, relay winding RW5 is deenergized by contact RC8-1, relay winding RW6 is deenergized by contact RC5-2, and reenergization of relay winding RW7 is prevented by contact RC6-1. When relay winding RW8 is energized, relay winding RW4 is also energized by contact RC8-3 and latched by contact RC4-1 for one cycle of cam wheel CW4 until microswitch CM4 opens. Solenoid S4 is actuated by contact RC4-2 while relay winding RW4 is energized to open valve 160 (FIG. 5), which supplies air to port 92 (FIG. 12). Thus, solenoid S4 is energized during the cycle following solenoid S3.

Figure 13:
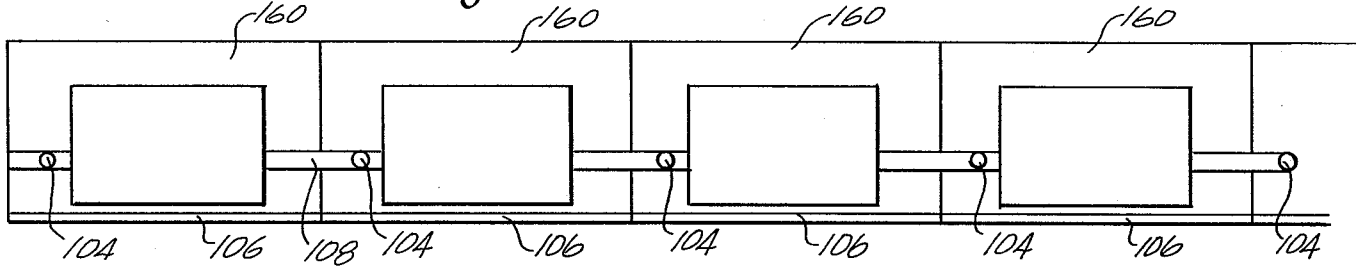
FIGS. 13 and 14 are top and side elevation views, respectively, of the gathering track.
Figure 14:
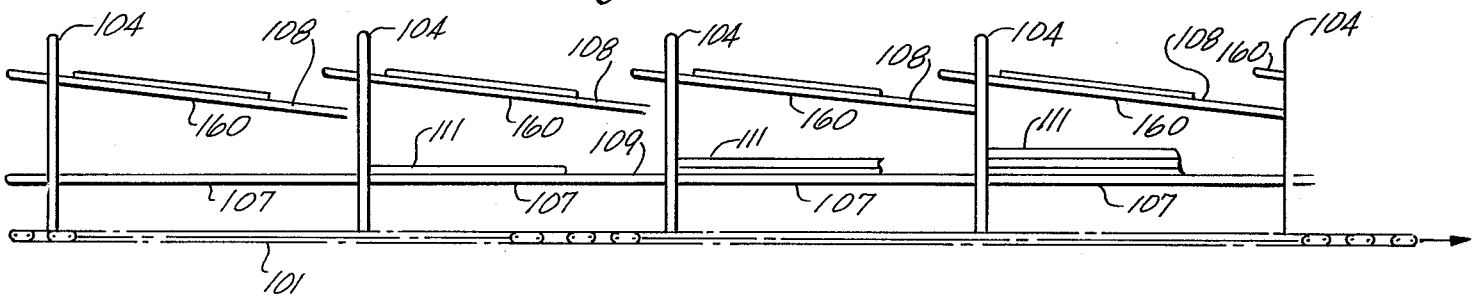
Figure 15:
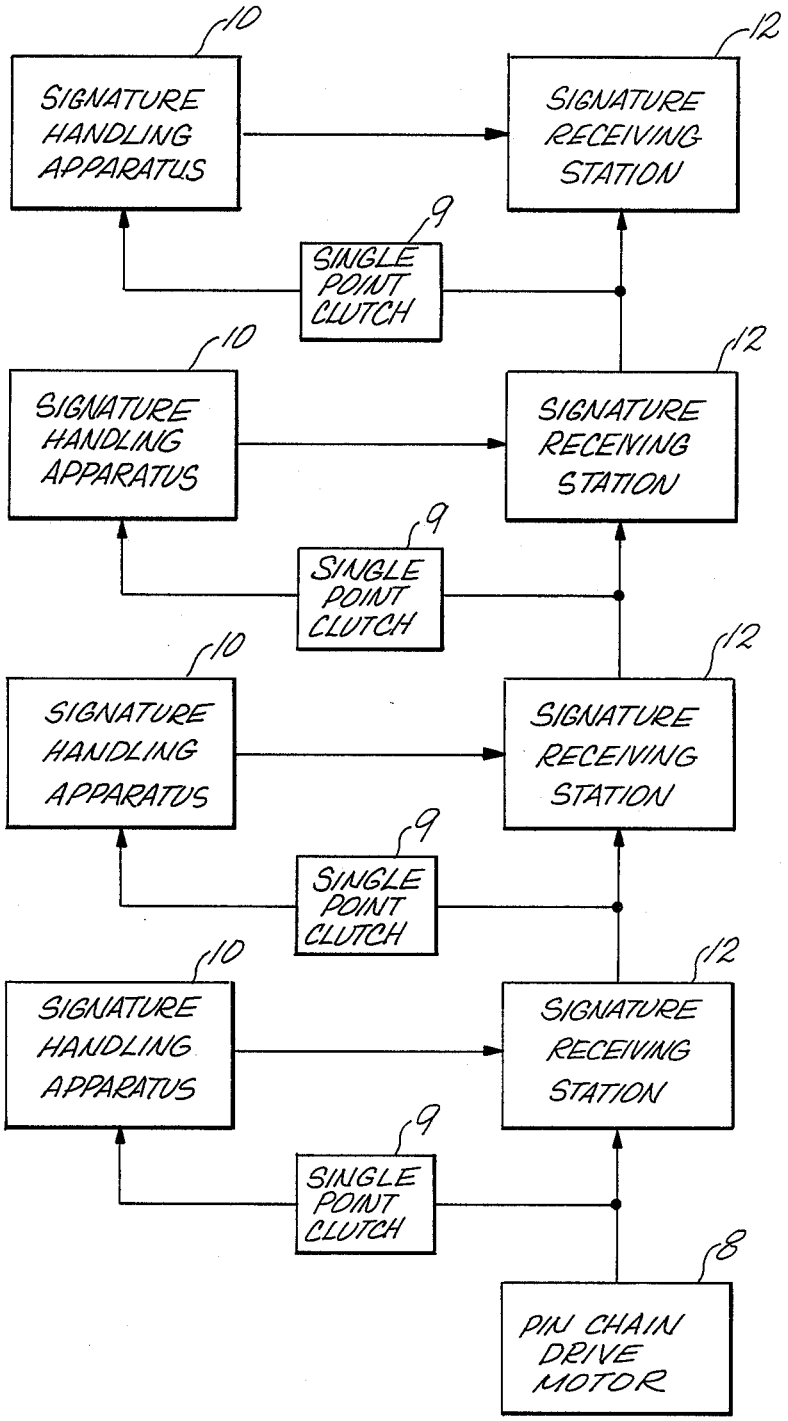
FIG. 15 is a schematic block diagram of units of the apparatus utilized to feed directly the gathering track of a conventional gathering machine.
Figure 16:
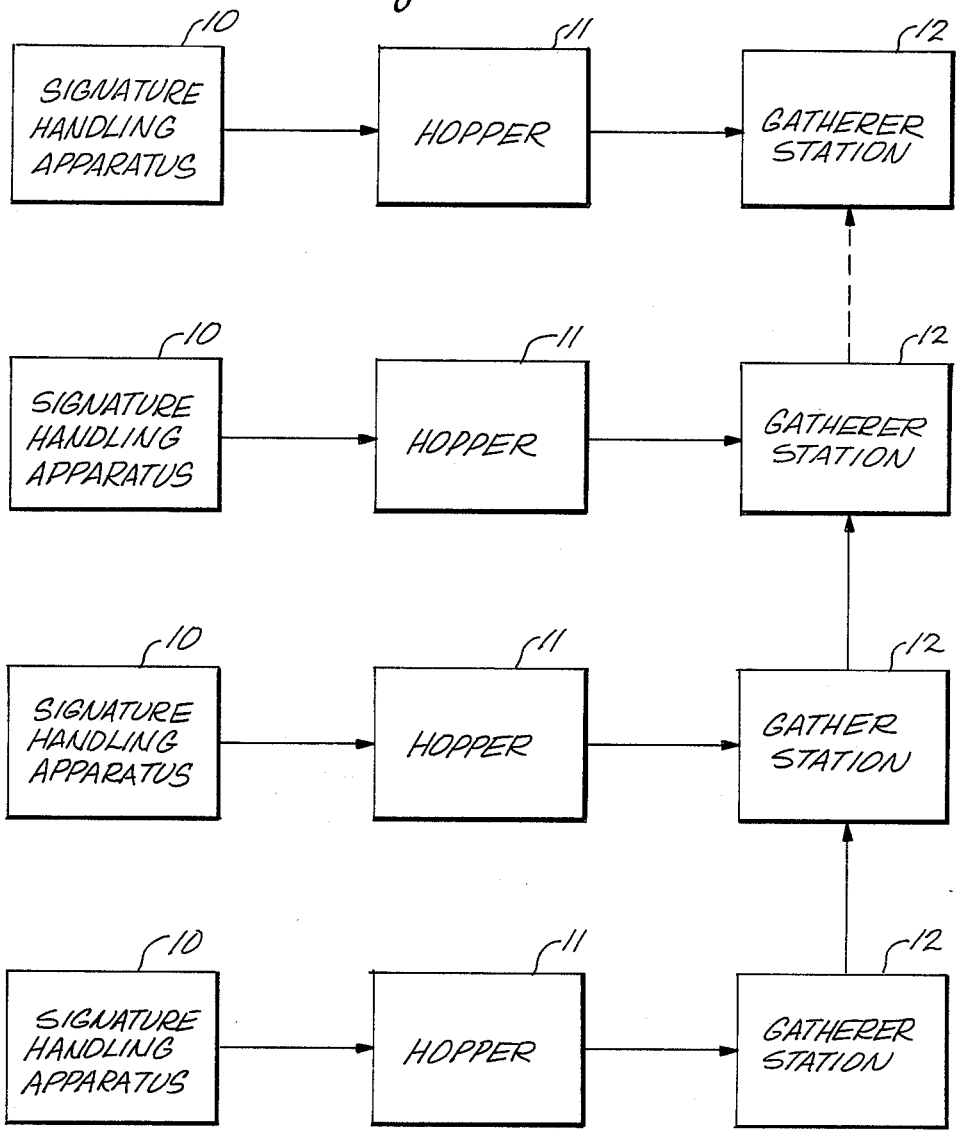
FIG. 16 is a schematic block diagram of units of the apparatus utilized to load the hoppers of a conventional gathering machine.

Although it is preferable to feed gathering track 4 directly with the described apparatus, so the signatures are directly and indirectly supplied thereto in synchronizm with the gatherer pin chain, the described apparatus could alternatively feed signatures to hoppers in which the signatures are stored on top of each other in a vertical stack. This permits the described apparatus to be provided as retrofit equipment for feeding the hopper of an existing prior art gatherer having gripping members that pull the signatures off of the bottom of the stack in the hoppers. FIG. 13 illustrates this application of the invention. The units of the described signature handling apparatus are designated 10. The hoppers for each unit are designated 11 and the gatherer stations for each unit including gripping members to pull the bottom signature from the stack are designated 12. Units 10 automatically supply signatures to hopper 11 at a rate required to keep hopper 11 full to a predetermined stack level, thereby eliminating the need for a manual hopper loading operation. In this embodiment, the described apparatus need not be synchronized to the gatherer pin chain on a signature-to-signature basis.

What is claimed is:

1. Apparatus for transforming a stack of signatures into a moving stream of individually arranged signatures, the apparatus comprising:

means for feeding a stack of signatures on edge in a given horizontal direction to a transfer station;

a signature conveyor at the transfer station for individually transporting the signatures as a moving stream, the conveyor having an entrance laterally offset from the stack;

a transfer arm having a plurality of vacuum cups for engaging the face in each signature as it arrives at the transfer station;

first means for moving the transfer arm in a vertical direction toward the entrance to carry each signature of the stack in turn vertically from the stack to the conveyor as such signature arrives at the transfer station;

second means for moving the transfer arm in the given direction as the transfer arm carries such signature from the stack vertically to the conveyor to reduce friction between such signature and the adjacent signature on the stack; and means for moving the transfer arm opposite the given direction between signature carries of the transfer arm.

2. The apparatus of claim 1, in which the transfer arm is moved in a third oval path including a vertical straight line path so that the transfer arm approaches the signatures while moving in part toward the stack and in part along the straight line path.

3. The apparatus of claim 2, in which the speed of the transfer arm while approaching the signature is approximately the same as the linear speed of the pinch rollers.

4. The apparatus of claim 1, additionally comprising means for periodically arresting the feeding means during the interval that each signature is being carried by the transfer arm.

5. The apparatus of claim 1, additionally comprising means for injecting air between the signature being carried by the transfer arm and the stack to facilitate separation of such signature from the stack.

6. The apparatus of claim 1, in which the transport speed of the conveyor relative to the repetition rate of the transfer arm is such that the moving stream of signatures transported by the conveyor is shingled, the apparatus additionally comprising means for separating the signatures transported by the conveyor.

7. The apparatus of claim 1, additionally comprising a frame at the transfer station and a plurality of horizontal idle rollers mounted on the frame in the path of the stack, the axes of the idle rollers lying in a vertical plane parallel to the signatures of the stack.

8. The apparatus of claim 7, in which the frame has a slot through which the transfer arm passes as it moves.

9. The apparatus of claim 8, additonally comprising means for sensing the movement of a signature being fed to the transfer station when such signature engages the idle rollers and means for periodically arresting the feeding means during the interval that each signature is being carried by the transfer, the arresting means comprising first means synchronized to the transfer arm for arresting the feeding means each time a signature is fed into the transfer station and second means for arresting the feeding means responsive to the sensing means.

10. The apparatus of claim 1, additionally comprising means for periodically arresting the feeding means during the interval that each signature is being carried by the transfer arm.

11. The apparatus of claim 1, additionally comprising means for injecting air between the signature being carried by the transfer arm and the stack to facilitate separation of such signature from the stack.

12. The apparatus of claim 1, in which the transport speed of the conveyor relative to the repetition rate of the transfer arm is such that the moving stream of signatures transported by the conveyor is shingled, the apparatus additionally comprising means for separating the signatures transported by the conveyor.

13. The apparatus of claim 1, additionally comprising a frame at the transfer station and a plurality of horizontal idler rollers mounted on the carriage in the path of the stack, the axes of the idle rollers lying in a vertical plane parallel to the signatures of the stack.

14. The apparatus of claim 1, in which the transfer arm, the stack and the conveyor are so positioned relative to each other that as the transfer arm engages a signature (B) of the stack, the preceding signature (A) of the stack engaged by the transfer arm is being transported by the conveyor and at least one vacuum cup engages the face of each of said signatures (A and B), thereby coupling said signatures together.

15. The apparatus of claim 14, in which the conveyor includes a pair of pinch rollers at the entrance of the conveyor for receiving and transporting each signature of the stack from the gripping means.

16. The apparatus of claim 15, in which the transfer arm moves in a vertical straight line path as the signatures are being carried from the stack to the conveyor.

17. The apparatus of claim 16, in which the speed of the transfer arm during movement through the vertical, straight line path is approximately the same as the linear speed of the pinch rollers.

18. Apparatus for collating a plurality of stacks of signatures comprising:

collating means having a plurality of gatherer stations equal to the plurality of stacks, the collating means receiving individual signatures at the respective gatherer stations and collating such individual signatures;

means for feeding each stack of signatures on edge vertically to a corresponding transfer station;

a signature conveyor at each transfer station for individually transporting the corresponding signatures as a moving stream to the corresponding gatherer station for individual reception and collating without restacking, the conveyor having an entrance above and laterally offset in a vertical direction from the stack;

means corresponding to each stack for carrying each signature of the stack in turn laterally to the corresponding conveyor as such signature arrives at the corresponding transfer station; and means corresponding to each stack for pulling such signature away from the stack as it is carried laterally to the corresponding conveyor.

19. A method for transforming a stack of signatures into a moving stream of individually arranged signatures, the method comprising the steps of;

feeding a stack of vertically arranged signatures to a transfer station;

individually transporting the signatures at the transfer station as a moving stream away from an entrance having a pair of adjacent rotatably driven pinch rollers laterally offset from the stack; and carrying each signature of the stack in turn laterally into the nip of the pinch rollers at approximately the same speed as the linear speed of the pinch rollers as such signature arrives at the transfer station.

20. Apparatus for transforming a stack of signatures into a moving stream of individually arranged signatures, the apparatus comprising:

means for feeding a stack of signatures on edge in a given direction to a transfer station;

a signature conveyor at the transfer station for individually transporting the signatures as a moving stream, the conveyor having an entrance laterally offset from the stack;

a transfer arm having a plurality of vacuum cups for engaging the face of the signature being carried opposite the stack;

first means for moving the transfer arm transverse to the given direction toward the entrance to carry each signature of the stack laterally from the stack to the conveyor as such signature arrives at the transfer station;

second means for moving the transfer arm in the given direction as the transfer arm carries such signature from the stack laterally to the conveyor to reduce friction between signatures and the adjacent signature on the stack; and means for moving the transfer arm opposite the given direction between signature carries of the transfer arm.

21. The apparatus of claim 20, in which the transfer arm is moved in a tilted oval path including a vertical straight line path so that the transfer arm approaches the signatures while moving in part toward the stack and in part along the straight line path.

* * * * *